US008434255B2

(12) United States Patent
Kefer

(10) Patent No.: US 8,434,255 B2
(45) Date of Patent: May 7, 2013

(54) BREECH BLOCK FOR A DROP-DOWN BARREL WEAPON

(75) Inventor: Hubert Kefer, Bad Ischl (AT)

(73) Assignee: STEYR MANNLICHER Holding GmbH, Kleinraming (AT)

( * ) Notice: Subject to any disclaimer, the term of this patent is extended or adjusted under 35 U.S.C. 154(b) by 972 days.

(21) Appl. No.: 12/522,399

(22) PCT Filed: Jan. 18, 2007

(86) PCT No.: PCT/AT2007/000018
§ 371 (c)(1),
(2), (4) Date: Jul. 8, 2009

(87) PCT Pub. No.: WO2008/086547
PCT Pub. Date: Jul. 24, 2008

(65) Prior Publication Data

US 2011/0083352 A9 Apr. 14, 2011

(51) Int. Cl.
*F41A 3/58* (2006.01)
*F41A 19/27* (2006.01)
*F41A 17/64* (2006.01)

(52) U.S. Cl.
USPC ..... 42/69.01

(58) Field of Classification Search ..... 42/2, 8, 42/23, 38, 40, 41, 69.01, 70.08; 89/27.11, 89/27.12
See application file for complete search history.

(56) References Cited

U.S. PATENT DOCUMENTS

| | | | | | |
|---|---|---|---|---|---|
| 644,660 | A * | 3/1900 | Caldwell | 42/70.08 |
| 3,157,958 | A * | 11/1964 | Lewis | 42/70.08 |
| 3,762,089 | A * | 10/1973 | Meyer, Jr. | 42/70.08 |
| 3,988,848 | A * | 11/1976 | Chatigny | 42/70.08 |
| 4,316,341 | A * | 2/1982 | Landry | 42/70.08 |
| 4,391,057 | A * | 7/1983 | Bornancini | 42/65 |
| 4,449,312 | A * | 5/1984 | Ruger et al. | 42/66 |
| 4,621,445 | A * | 11/1986 | Rohm | 42/66 |
| 4,680,884 | A * | 7/1987 | Smith et al. | 42/66 |
| 4,807,380 | A * | 2/1989 | Domian | 42/65 |
| 4,879,827 | A | 11/1989 | Gentry | |
| 5,225,611 | A * | 7/1993 | Scott | 42/42.03 |
| 5,625,970 | A * | 5/1997 | Pantuso et al. | 42/66 |
| 6,698,125 | B2 * | 3/2004 | Baker | 42/66 |

FOREIGN PATENT DOCUMENTS

| | | |
|---|---|---|
| AT | 376 497 | 11/1984 |
| DE | 94620 | 11/1896 |
| EP | 0855569 A1 | 1/1998 |
| EP | 0862038 A2 | 1/1998 |

* cited by examiner

*Primary Examiner* — Bret Hayes
(74) *Attorney, Agent, or Firm* — Hoffmann & Baron, LLP

(57) ABSTRACT

Breech block for a drop-down barrel weapon, having at least one firing pin, which is guided such that it can move axially therein, has an impact head at its rear end for a firing piece to strike, and has a firing tip at its front end in order to fire a cartridge, with a safety slide being guided such that it can move laterally in a recess on the firing piece side of the breech block between a first position in which a portion thereof in the form of a spacer head projects beyond the impact head of the firing pin in the impact area of the firing piece and a second position in which it is withdrawn from the impact area of the firing piece, which recess is at least partially closed by a cover plate with the cover plate having recesses for the impact head and the spacer head to pass through.

13 Claims, 4 Drawing Sheets

BREECH BLOCK FOR A DROP-DOWN BARREL WEAPON

This application is the U.S. National Phase of International Application No. PCT/AT2007/000018 filed on Jan. 18, 2007, the disclosure of which is incorporated herein by reference.

BACKGROUND OF THE INVENTION

The present invention relates to a breech block for a drop-down barrel weapon with at least one firing pin, which is guided to be axially displaceable therein and which has an impact head at its rear end for a firing piece to strike against and a firing tip at its front end for firing a cartridge, and also a block lock with such a breech block.

A breech block of this type is known from patent EP 0 855 569 or EP 0 862 038, for example.

Numerous systems are already known to secure block locks against unintentional release such as, for example, catch hooks for the firing pieces, holding devices for the tension springs etc., which are disengaged to release the safety mechanism of the weapon.

Thus, patent DE 94 620 C, for example, discloses two levers, which are spring-loaded on the breech block and pivot in front of (and around) the firing pin ends in a scissor-like arrangement that can be forced open by a control rod in order to move the levers downwards out of the impact area of the hammer.

All known safety systems require an increased expenditure with respect to the firing mechanism and, moreover, with particularly intense vibrations of the weapon, there is the risk of the catch hooks, levers, scissor arrangements etc. becoming detached again as a result of the lever-like effect of their moments of inertia, and this is an extremely dangerous situation. Moreover, the known safety systems require a considerable amount of space in the lock housing that is often not available, and are exposed to fouling that impairs their operability.

SUMMARY OF THE INVENTION

The aim set by the invention is to provide a safety system for a drop-down barrel weapon with block lock, which is simpler, less susceptible to failure and is substantially safer than the known designs. This aim is achieved with the breech block of the aforementioned type, which is distinguished according to the invention in that a safety slide is guided in a transversely displaceable manner in a recess on the firing piece side of the breech block between a first position, in which it projects beyond the impact head of the firing pin in the impact area of the firing piece, and a second position, in which it is pulled back from the impact area of the firing piece, which recess is at least partially closed by a cover plate, wherein the cover plate has recesses for the impact head and the spacer head to pass through.

The invention proposes a novel safety system concept for the first time that is directly integrated into the breech block. This results in a particularly space-saving, encapsulated safety system that is less susceptible to failure and is directly in the impact area of the firing pieces and thus at the end of the entire release sequence of the firing mechanism, i.e. it can prevent an unintentional firing of the cartridge in a safe manner without any additional space requirement, even if all prior safety mechanisms fail. The safety system concept of the invention is thus also particularly suitable for combining with conventional safety systems as a "double" or "last" safety mechanism. Moreover, the design according to the invention enables the breech block to be fabricated particularly simply substantially in one piece, and the cover plate can be used at the same time for assembly of the firing pins and the safety slide.

The safety slide can overlap the impact head of the firing pin. However, it is particularly advantageous if according to a further feature of the invention the safety slide has a spacer head for each firing piece, which spacer head lies directly next to the firing pin in said first position and thus, when viewed in the axial direction of the firing pin, projects further than its impact head. This securely prevents the risk of an unintentional contact of the impact head as a result of material elasticity and bending effects during impact of the firing pieces: the spacer head of the safety slide lies as solid spacer between the struck firing piece and the firing pin.

The safety slide is preferably biased by a spring in the direction of the first position, as a result of which safety can be increased even further.

In any case, it is particularly advantageous if the safety slide has a ramp for a control rod for its displacement. As a result, the safety slide can be controlled from a remote location, e.g. from an operating element on the handle of the stock, which displaces the safety slide via the control rod.

In a further aspect, the invention also provides a block lock for a drop-down barrel weapon with a breech block of the type according to the invention and a link with at least one firing piece, which during firing strikes against the safety slide or its spacer head in the first position of the safety slide and strikes against the impact head of the firing pin in the second position of the safety slide.

BRIEF DESCRIPTION OF THE DRAWINGS

The invention shall be explained in more detail below on the basis of an exemplary embodiment shown in the attached drawings.

DETAILED DESCRIPTION OF THE INVENTION

Figure 1:
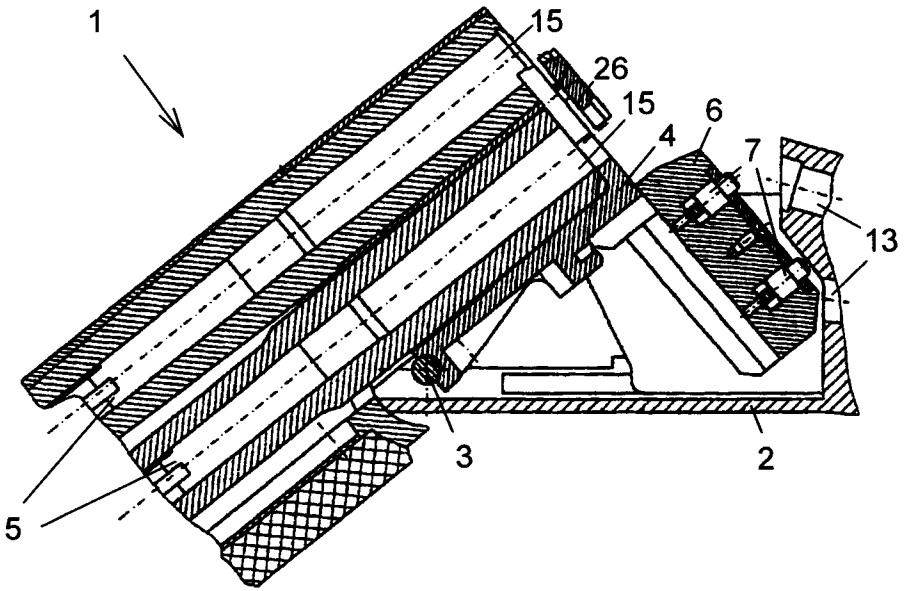
FIG. 1 is a sectional view of a block lock for a drop-down barrel weapon (only shown in sections) in the open position.

A drop-down ("tip-up") barrel weapon 1 is shown in sections in FIG. 1, i.e. only in the region of its (here: open) block lock. The block lock comprises a link 2 and a mount 4 articulated thereto at 3 to accommodate two barrels 5 and a breech block 6, which is guided to be transversely displaceable on the mount 4, as is known in the art.

Figure 2:
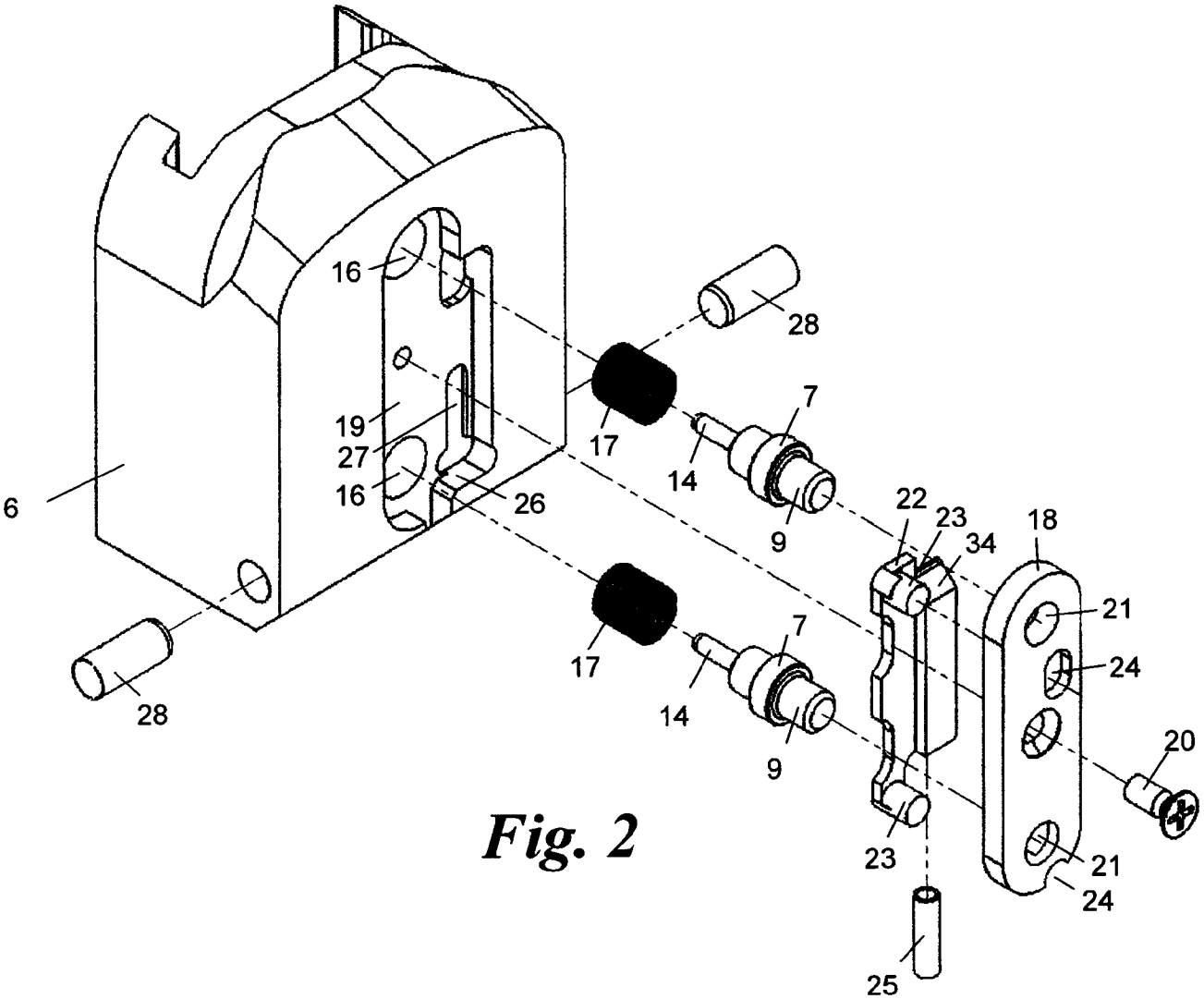
FIG. 2 is an exploded perspective view of the breech block of the invention.

FIG. 2 shows the breech block 6 in detail. The breech block 6 contains two firing pins 7 guided displaceably in axial direction. Each firing pin 7 has an impact head 9 on its rear side for one respective firing piece 11 (FIGS. 3 and 4), which is guided in guides 13 (FIG. 1) of the link 2 and is biased for firing, as is known to the person skilled in the art. On its front side each firing pin 7 has a firing tip 14 for firing a cartridge (not shown) in the cartridge storage areas 15 of the barrels 5.

The firing pins 7 are guided in stepped holes 16 of the breech block 6 and respectively biased towards the firing pieces 11 by a pressure spring 17 supported between a step of the hole 16 and a shoulder of the firing pin 7. The firing pins 7 are held by a cover plate 18, which is inserted into a cut-out 19 of the breech block 6 and is secured there by means of a screw 20. The impact heads 9 of the firing pins 7 thus pass through recesses 21 of the cover plate 18.

A safety slide 22 is displaceably guided transversely to the direction of movement of the firing pins 7 in the cut-out 19 of the breech block 6 under the cover plate 18. The safety slide 22 has two spacer heads 23, which respectively pass through recesses 24 of the cover plate 18 and project beyond the plane of the impact heads 9 of the firing pins 7 when they are located in the impact region of the firing pieces 11.

Figure 3:
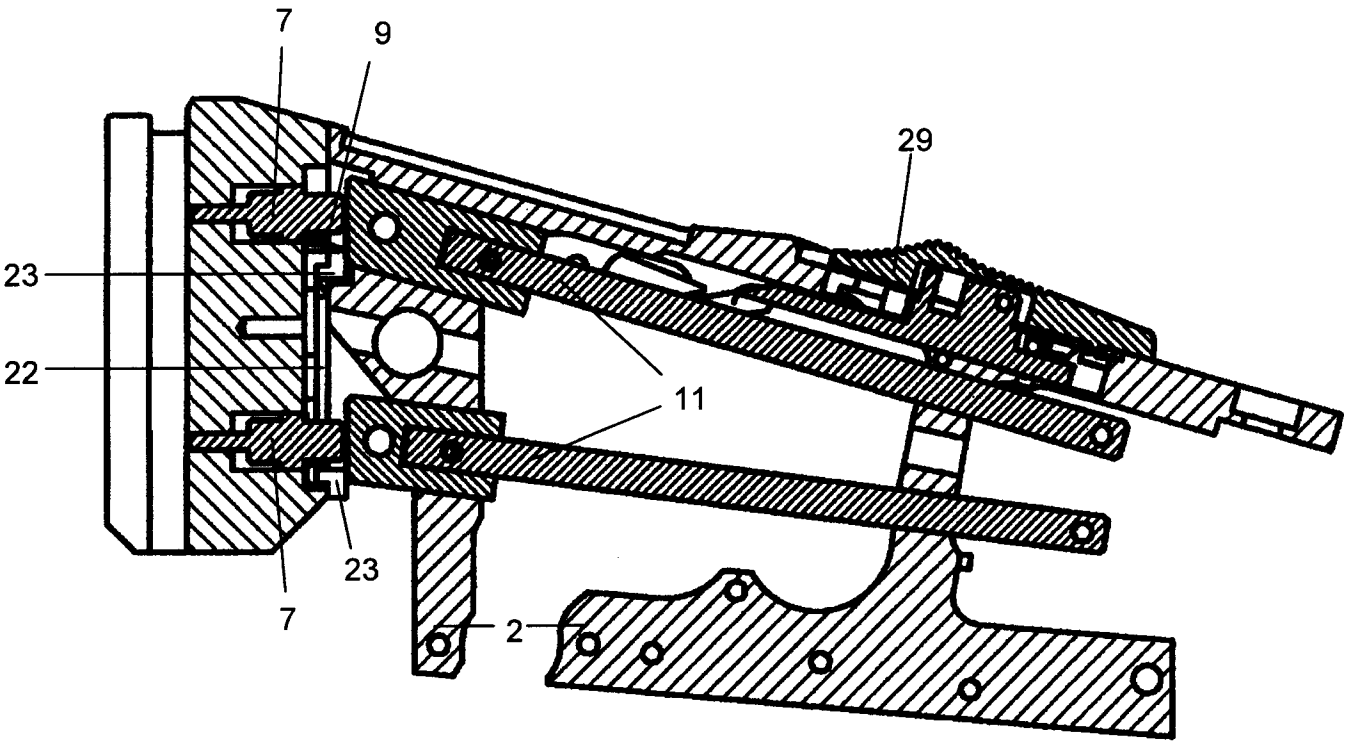
FIGS. 3 and 4 are two schematic side views showing the interaction of the breech block with the firing pieces of the links, i.e. in the secured position (FIG. 3) and in the safety-release position (FIG. 4).
Figure 4:
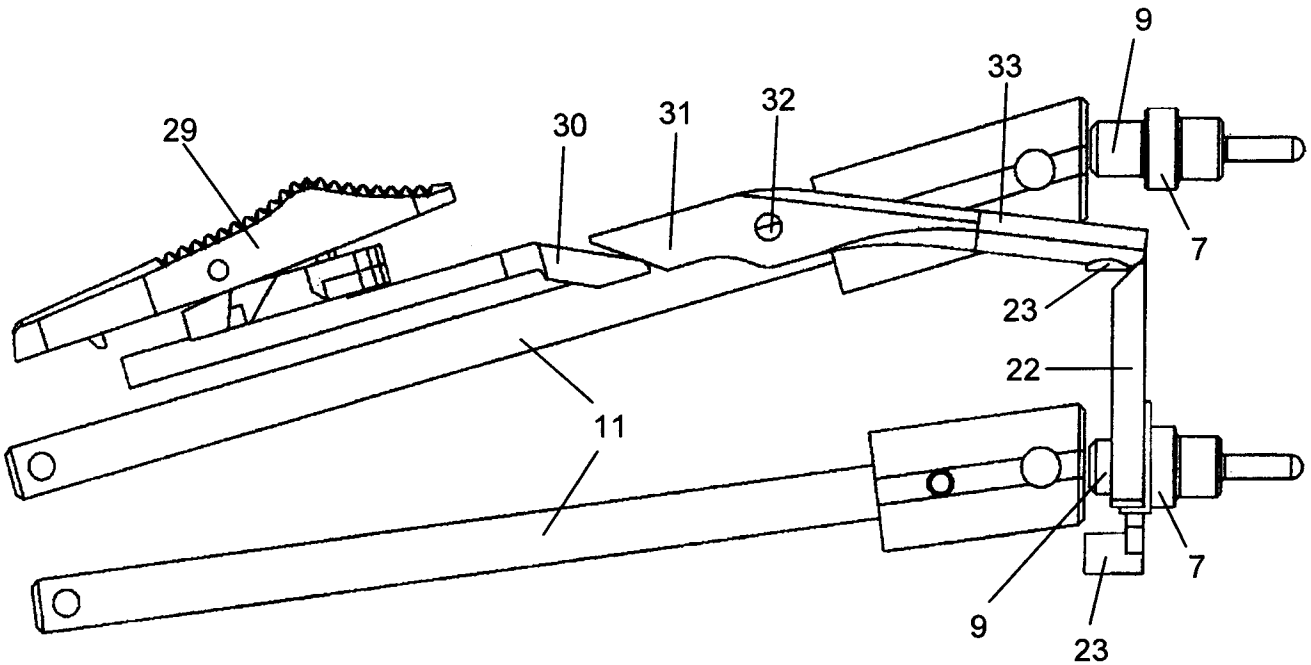

FIGS. 3 and 4 show this in detail. In the secured position of the weapon shown in FIG. 3, the safety slide 22 is located in its first upper position, in which its spacer heads 23 project into the impact region of the firing pieces 11 and securely space these from the impact heads 9 of the firing pins 7 in the struck or impact position. The spacer heads 23 are thus placed or clamped between the firing pieces 11 and the breech block 6 in the manner of a wedge.

In the safety-release position of the weapon shown in FIG. 4, the safety slide 22 is located in its second lower position, in which its spacer heads 23 are removed from the impact region of the firing pieces 11, so that these can strike against the impact heads 9 of the firing pins 7 unhindered.

Instead of the shown wedge effect, in a simplified variant the safety slide could also project beyond the impact heads 9, i.e. overlap these, in its sliding direction. However, the shown embodiment is more favourable, in which the safety slide lies next to the firing pins and projects in the axial direction thereof in order to prevent any risk of contact of the impact heads.

According to FIG. 2, the safety slide 22 is biased in the direction of its first secured position by means of a (schematically shown) pressure spring 25. The pressure spring 25 is supported on one side against a side wall 26 of the cut-out 19 and on the other side against the underside of the safety slide 22 and is partially received in a depression 27 of the cut-out 19.

In addition, the breech block 6 is provided with lateral control studs 28, which cooperate with corresponding link guides in the link 2 in a known manner in order to slide, when the mount 4 tips downwards, into the open position shown in FIG. 1, in which the cartridge storage area 25 is accessible and can be emptied by means of a cartridge extractor 26 and loaded again.

FIG. 4 shows the mechanism for operating the safety slide 22 in detail. An operating slide 29 mounted on the link 2 or the housing of the weapon (not shown) controls a lever 31 over a guide face 30, said lever being articulated to the link 2 at 32 and moulded to form a control rod 33 at its other lever arm. The control rod 33 presses against a ramp 34 (FIG. 2) of the safety slide 22 in order to move this downwards against the force of the spring 25 into its safety-release position when the operating slide 29 is pushed forwards.

The invention is not restricted to the shown exemplary embodiments, but covers all variants and modifications that fall within the framework of the attached claims.

What is claimed is:

1. Breech block for a drop-down barrel weapon comprising:

at least one firing pin axially displaceable in the breech block, the firing pin having an impact head at its rear end for a firing piece to strike against and a firing tip at its front end for firing a cartridge, and a safety slide, wherein the breech block includes a recess formed on a firing piece side of the breech block to receive the safety slide, the safety slide being transversely displaceable within the recess between a first position, in which a portion of the safety slide projects beyond the impact head of the firing pin in the impact area of the firing piece to prevent unintentional contact of the firing piece with the impact head, and a second position wherein the safety slide is pulled back from the impact area of the firing piece to allow the firing piece to contact the impact head of the firing pin.

2. Breech block according to claim 1, wherein the portion of the safety slide that projects beyond the impact head is a spacer head, the spacer head being positioned adjacent to the firing pin in the said first position and, when viewed in an axial direction in relation to the firing pin, the spacer head projects outwardly towards the firing piece further than the impact head of the firing pin and wherein the recess has a depth such that only the spacer head of the safety slide projects beyond an outer surface of the firing piece side of the beech block.

3. Breech block according to claim 1, wherein the safety slide is biased by a spring in the direction of the first position.

4. Breech block according to claim 1, wherein the safety slide has a ramp and the breech block further includes a control rod operable to press against the ramp to move the safety slide to the second position.

5. Breech block according to claim 1, wherein the recess for the safety slide is at least partially closed by a cover plate, and wherein the cover plate has an opening through which the impact head of the firing pin passes through.

6. A block lock for a drop-down barrel weapon comprising:

a breech block including at least one firing pin axially displaceable in the breech block, the firing pin having an impact head at its rear end for a firing piece to strike against and a firing tip at its front end for firing a cartridge, and a safety slide transversely displaceable within a recess formed on a firing piece side of the breech block, the safety slide being displaceable between a first position, wherein a portion of the safety slide projects beyond the impact head of the firing pin in an impact area of the firing piece, and a second position, wherein the safety slide is pulled back from the impact area of the firing piece to allow the firing piece to contact the impact head of the firing pin, and further wherein the at least one firing piece includes a link, which, during firing, strikes against the portion of the safety slide which projects beyond the impact head of the firing pin in the first position and strikes against the impact head of the firing pin in the safety slide second position.

7. A block lock for a drop-down barrel weapon according to claim 6, wherein the recess in which the safety slide moves is at least partially closed by a cover plate, the cover plate being flush mounted with respect to an outer surface of the breech block, and wherein the cover plate has openings through which the impact head of the firing pin passes through.

8. A block lock for a drop-down barrel weapon according to claim 6, wherein the portion of the safety slide which projects beyond the impact head of the firing pin is a spacer head, the spacer head being positioned directly next to the firing pin in the said first position such that when viewed in an axial direction with respect to the firing pin, the spacer head projects further than the impact head.

9. A block lock for a drop-down barrel weapon according to claim 6, wherein the safety slide is biased by a spring in the direction of the first position.

10. A block lock for a drop-down barrel weapon according to claim 6, wherein the safety slide has a ramp, and wherein the block lock includes a control rod operable to move the safety slide between the first position and second position.

11. A breech block for a drop-down barrel weapon comprising:

at least one firing pin axially displaceable within an aperture in the breech block, the at least one firing pin including an impact head at one end thereof for impact by a respective firing piece and a firing tip at the opposite end for firing a cartridge; and a safety slide movable transversely to a direction of movement of the at least one firing pin, the safety slide being positioned within a recess formed in a firing piece side of the breech block and movable between a first secured position, in which a spacer head portion of the safety slide is placed in an impact area between the firing piece and the breech block to prevent the firing piece from striking on the impact head of the firing pin, and a second firing position in which the spacer head portion of the safety slide is moved away from the impact area so that the firing piece can strike the impact head of the firing pin, wherein the recess has a depth such that only the spacer head portion of the safety slide projects beyond an outer surface of the firing piece side of the breech block.

12. A breech block for a drop-down barrel weapon according to claim 11, wherein the safety slide is biased by a pressure spring into the first position.

13. A breech block for a drop-down barrel weapon according to claim 11, further comprising a cover plate covering at least a portion of the recess in which the safety slide moves and having an aperture through which the spacer head portion of the safety slide passes.

* * * * *

UNITED STATES PATENT AND TRADEMARK OFFICE

CERTIFICATE OF CORRECTION

PATENT NO. : 8,434,255 B2
APPLICATION NO. : 12/522399
DATED : May 7, 2013
INVENTOR(S) : Hubert Kefer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 973 days.

Signed and Sealed this
Eighth Day of September, 2015

Michelle K. Lee

Michelle K. Lee
*Director of the United States Patent and Trademark Office*